US008086388B2

(12) United States Patent
Cinpinski et al.

(10) Patent No.: US 8,086,388 B2
(45) Date of Patent: Dec. 27, 2011

(54) CAMSHAFT PHASOR SYNCHRONIZATION SYSTEM FOR AN ENGINE

(75) Inventors: Kenneth J. Cinpinski, Ray, MI (US); Donovan L. Dibble, Utica, MI (US); Alexander J. Roberts, Commerce Township, MI (US); Vijay Ramappan, Novi, MI (US)

(73) Assignee: GM Global Technology Operations LLC

( * ) Notice: Subject to any disclaimer, the term of this patent is extended or adjusted under 35 U.S.C. 154(b) by 840 days.

(21) Appl. No.: 12/143,903

(22) Filed: Jun. 23, 2008

(65) Prior Publication Data

US 2009/0223472 A1 Sep. 10, 2009

Related U.S. Application Data

(60) Provisional application No. 61/033,572, filed on Mar. 4, 2008.

(51) Int. Cl.
*B60T 7/12* (2006.01)

(52) U.S. Cl. ..... 701/103; 123/90.17

(58) Field of Classification Search ..... 701/102, 701/103, 115; 123/90.11, 90.15–90.18, 90.27, 123/90.31, 90.34, 693, 694
See application file for complete search history.

(56) References Cited

U.S. PATENT DOCUMENTS

| | | | | |
|---|---|---|---|---|
| 5,647,318 | A * | 7/1997 | Feucht et al. | 123/322 |
| 7,584,044 | B2 * | 9/2009 | Mladenovic et al. | 701/102 |
| 7,742,866 | B2 * | 6/2010 | McLain et al. | 701/103 |
| 2004/0003788 | A1 | 1/2004 | Taylor et al. | |
| 2009/0145384 | A1 * | 6/2009 | Cinpinski et al. | 123/90.17 |

* cited by examiner

*Primary Examiner* — John Kwon

(57) ABSTRACT

A camshaft phasor control system for an engine includes a first camshaft position sensor that generates a first camshaft position signal based on a position of a first camshaft. A first summer generates a first error signal based on the first camshaft position signal and a first commanded position signal. A control module generates a raw duty cycle based on the first error signal. A second summer generates a modified duty cycle based on the raw duty cycle and a modifier. The control module generates the modifier based on the first error signal and speed of the first camshaft relative to a second camshaft.

20 Claims, 5 Drawing Sheets

CAMSHAFT PHASOR SYNCHRONIZATION SYSTEM FOR AN ENGINE

CROSS-REFERENCE TO RELATED APPLICATIONS

This application claims the benefit of U.S. Provisional Application No. 61/033,572, filed on Mar. 4, 2008. The disclosure of the above application is incorporated herein by reference in its entirety.

FIELD

The present invention relates to engine control systems, and more particularly to camshaft position and speed control systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A camshaft actuates valves of an internal combustion engine. In a dual overhead camshaft configuration, the engine includes an exhaust camshaft and an intake camshaft for each bank of cylinders. Rotation of the camshafts actuates intake and exhaust valves of the engine. Position and timing between a crankshaft and the camshafts are adjusted for proper synchronization of intake and exhaust valve events to cylinder piston positioning.

An engine control system may include one or more camshaft phasing devices (camshaft phasors). A camshaft phasor may be used to create a variable rotational offset between the exhaust camshaft and the intake camshaft and/or the crankshaft. The offset alters opening and closing times between intake and exhaust valves.

Engines configured with multiple camshaft phasors can exhibit regions of operation with reduced performance or driveability or increased emissions due to a mismatch between the phasors. This mismatch in phasor performance may refer to a difference in relative velocities between the phasors. The mismatch can contribute to conditions of excessive overlap and high dilution or reduced overlap and low dilution during periods of transition. Overlap refers to when both intake and exhaust values are in an open state during the same time period. Dilution refers to the capturing of diluent gas (exhaust gas) in a cylinder. The mismatched performance may be due to different loading on each of the camshafts.

For example, depending upon whether a phasor is moving in a retarding or advancing direction, the response rate of the phasor may be different due to engine loading on the phasor. As another example, when a torque balance is used on a phasor, such as a return spring, the rate that the phasor responds may be different than a phasor without a torque balance. As a further example, when a device is driven off of one camshaft, such as a fuel pump driven off of an exhaust camshaft, the camshaft responds differently than another camshaft without such loading. As yet another example, the fluid pressure between phasors and/or the supply voltage to phasors may be different. This also results in variability in performance of phasors.

A camshaft phasor based control system typically includes a control valve and a phasor. The control valve is used to adjust passage of hydraulic fluid to the phasor based on a commanded position signal. The flow of hydraulic fluid controls movement of a vane or valve shuttle within the phasor and thus relative positioning between camshafts and/or a crankshaft. Once the valve shuttle is in a commanded (desired) position, fluid flow to and from the control valve is stopped, thereby locking the actuator of the camshaft phasor in a fixed position. This position is referred to as a control hold position.

The positioning of the valve shuttle is achieved by varying the energy supplied to a solenoid which moves the valve shuttle via a control hold duty cycle (CHDC) signal. Typically, the CHDC signal is based on a regression model that is developed during manufacturing of a vehicle. The regression model is developed over time via vehicle testing and post processing of test data. Once developed, the regression model is stored in a camshaft phasor control system of a vehicle and is unchanged. Due to component wear, accuracy of the regression model decreases over time.

SUMMARY

A camshaft phasor control system for an engine is provided and includes a first camshaft position sensor that generates a first camshaft position signal based on a position of a first camshaft. A first summer generates a first error signal based on the first camshaft position signal and a first commanded position signal. A control module generates a raw duty cycle based on the first error signal. A second summer generates a modified duty cycle based on the raw duty cycle and a modifier. The control module generates the modifier based on the first error signal and speed of the first camshaft relative to a second camshaft.

In another feature, a camshaft phasor control system for an engine is provided and includes a first camshaft phasor position sensor that generates a first phasor position signal based on a position of a first phasor. A first summer generates a first error signal based on the first phasor position signal and a first commanded position signal. A control module generates a raw duty cycle based on the first error signal. A second summer generates a modified duty cycle based on the raw duty cycle and a modifier. The control module generates the modifier based on the first error signal and speed of the first phasor relative to a second phasor.

In another feature, the control module generates the modifier based on a ratio of a first product and a second product and a raw duty cycle relative to a null duty cycle range. The first product is of the first error signal and speed of the second phasor. The second product is of a second error signal of the second phasor and speed of the first phasor.

In still another feature, a method of operating a camshaft phasor control system for an engine is provided and includes generating a first camshaft position signal based on a position of a first camshaft. A first error signal is generated based on the first camshaft position signal and a first commanded position signal. A second camshaft position signal is generated based on a position of a second camshaft. A second error signal is generated based on the second camshaft position signal and a second commanded position signal. A duty cycle is generated for the first camshaft based on the first error signal, the second error signal, and speed of the first camshaft relative to the second camshaft.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
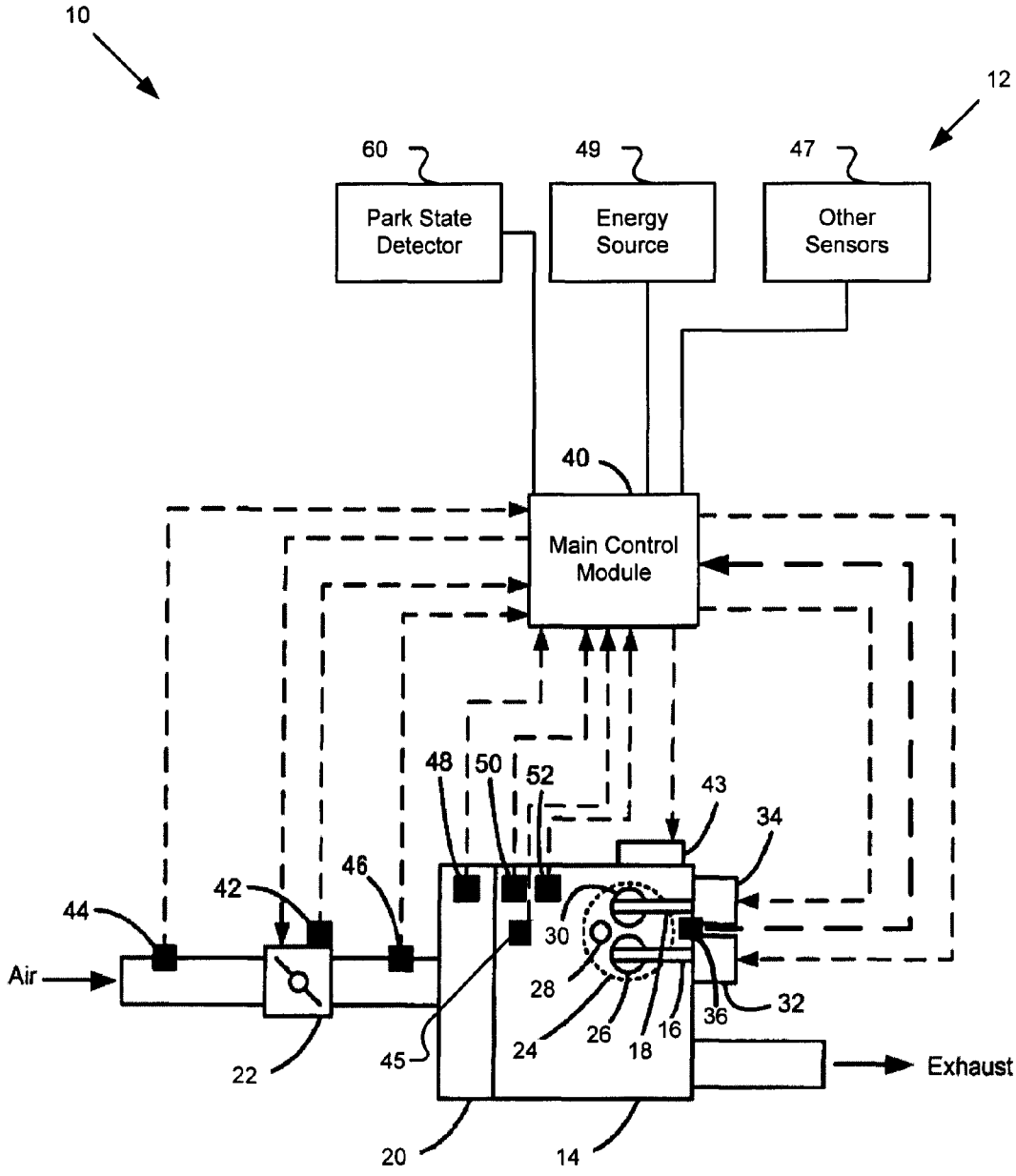
FIG. 1 is a functional block diagram of an engine control system that incorporates a camshaft phasor control system in accordance with an embodiment of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a functional block diagram of an engine control system 10 that incorporates a camshaft phasor control system 12 is shown. An engine control system 10 includes an engine 14 that has one or more camshafts 16, 18. Position of the camshafts 16, 18 is controlled via the camshaft phasor control system 12. The camshaft phasor control system 12 is tuned based on known camshaft phasor control circuit characteristics and closed loop system performance, which maybe obtained from engine performance improvement information. The camshaft phasor control system 12 adjusts the relative velocity of the camshafts 16, 18 to maintain uniform performance.

Figure 4:
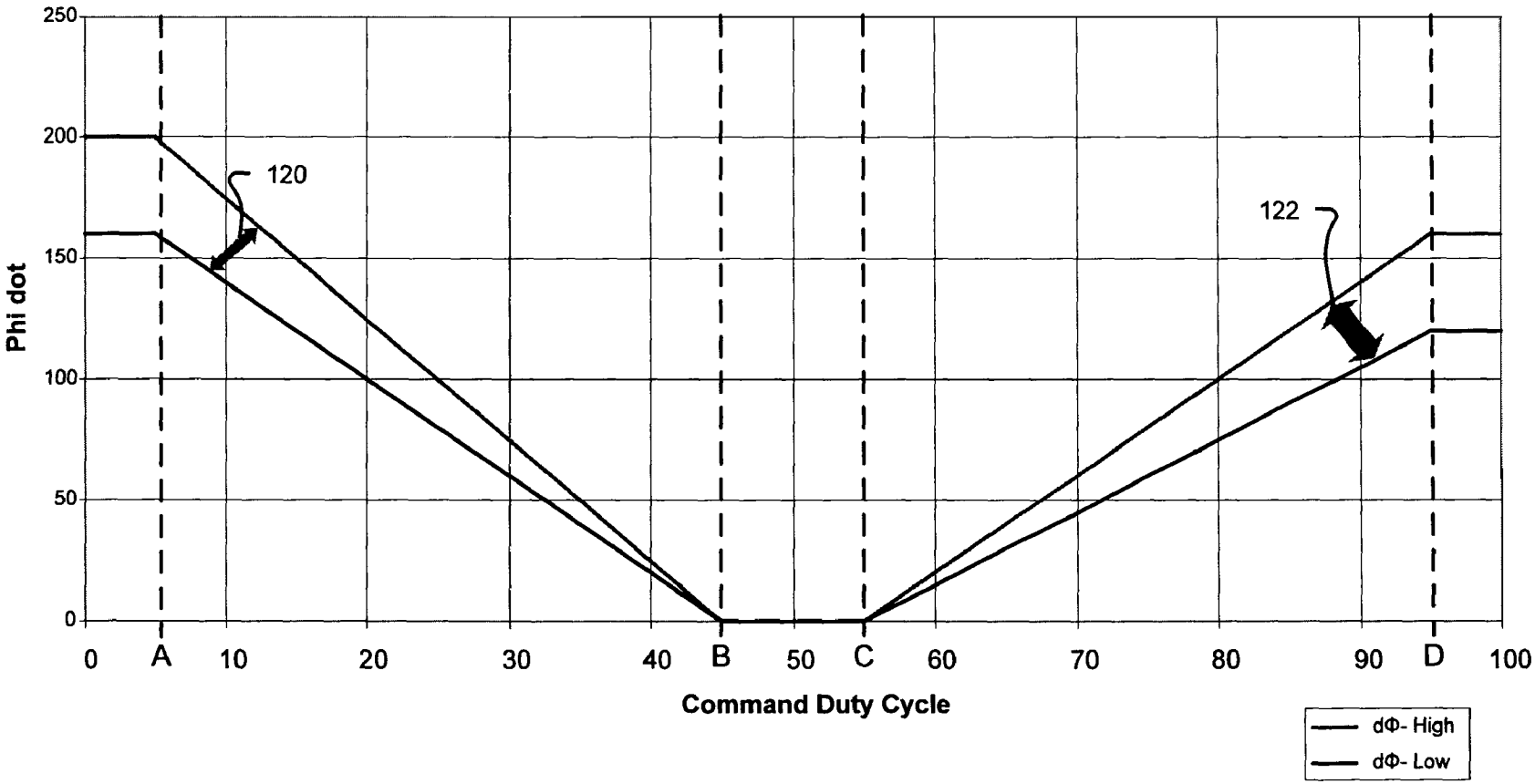
FIG. 4 is an exemplary phase control diagram illustrating camshaft phasor variability in accordance with an embodiment of the present disclosure.

The velocity to the camshafts 16, 18 relative to each other and to null duty cycle range may vary during engine operation and over time. An example of a null duty cycle range is shown in FIG. 4. This variance can occur due to different direction of motion of the camshafts 16, 18, mechanical loading on the camshafts 16, 18, fluid pressure and/or supply voltage of phasors of the camshafts 16, 18, component tolerance differences, component wear, etc. As an example oil pressure to different sides of a phasor may vary, as well as oil pressure to different phasors. As another example, variability may exist between electrical drivers of an electronic control module of the phasors. Variations may occur in hydraulically operated phasors and in electrically operated phasors. Depending upon the operating conditions, an engine may be aiding or abetting the direction of motion of a camshaft. This further affects the performance of a camshaft. Thus, the camshafts may be adjusted at different rates.

The embodiments of the present disclosure minimize and/or eliminate the difference in relative velocities between the camshafts to provide synchronized camshaft operation. Although the following embodiments are described primarily with respect to the synchronization of an intake camshaft and an exhaust camshaft, the present application may apply to two intake camshafts or to two exhaust camshafts.

The camshaft phasor control system 12 may have predetermined and stored control hold duty cycle (CHDC) values for different operating conditions or may learn the CHDC values over time. The camshaft phasor control system 12 may adaptively determines a CHDC value during operation of the engine 14. The CHDC values are stored and may be used and updated during a current operating event of the vehicle and/or used during a future operating event.

Camshaft phasor system characteristics may include gain, time constants, delay times, and other camshaft phasor characteristics. The engine performance improvement information may refer to camshaft and crankshaft position information, spark ignition, fuel injection, air flow, and other engine performance parameters. The camshaft phasor control system 12 may be used to adjust and/or control timing, fuel injection, air flow, etc.

In use, the engine control system 10 allows air to be drawn into an intake manifold 20 through a throttle 22. The throttle 22 regulates mass air flow into the intake manifold 20. Air within the intake manifold 20 is distributed into cylinders 24. Although a single cylinder 24 is illustrated, it is appreciated that the camshaft phasor control system 12 may be implemented in engines having any number of cylinders.

An intake valve 26 selectively opens and closes to enable the air/fuel mixture to enter the cylinder 24. The intake valve position is regulated by an intake camshaft 16. A piston compresses the air/fuel mixture within the cylinder 24. A spark plug 28 initiates combustion of the air/fuel mixture, driving the piston in the cylinder 24. The piston drives a crankshaft to produce drive torque. Combustion exhaust within the cylinder 24 is forced out an exhaust port when an exhaust valve 30 is in an open position. The exhaust valve position is regulated by an exhaust camshaft 18. The exhaust is treated in an exhaust system and is released to the atmosphere. Although single intake and exhaust valves 26, 30 are illustrated, it is appreciated that the engine 14 can include multiple intake and exhaust valves 26, 30 per cylinder 24.

The engine system 10 further includes an intake camshaft phasor 32 and an exhaust camshaft phasor 34 that respectively regulate the rotational timing and/or lift of the intake and exhaust camshafts 16, 18. More specifically, the timing of the intake and exhaust camshafts 16, 18 can be retarded or advanced with respect to each other or with respect to a location of the piston within the cylinder 24 or crankshaft position. The intake and exhaust camshaft phasors 32, 34 regulate the intake and exhaust camshafts 16, 18 based on signal output from one or more camshaft position sensors 36.

The camshaft position sensors 36 may be in the form of a camshaft phasor position sensor and measure position of an actuator. A camshaft position sensor may be included for each camshaft. The camshaft position sensors 36 can include, but is not limited to, variable reluctance or Hall Effect sensors. In one embodiment, the camshaft position sensors 36 are encoders that detect teeth on a rotating sprocket of the camshaft phasors 32, 34. The camshaft position sensors 36 transmit output signals that indicate rotational position of the intake or exhaust camshafts 16, 18. The transmission may occur when the camshaft position sensors 36 sense the passage of a spaced position marker (e.g. tooth, tab, and/or slot) on a disc or target wheel coupled to the intake or exhaust camshafts 16, 18.

A main control module 40 operates the engine based on the camshaft phasor control system 12. The main control module 40 may include a position control module, a gain scheduling module, and a gain calculation module. The main control module 40 generates control signals to regulate engine components in response to engine operating conditions. The main control module 40 generates a throttle control signal based on a position of an accelerator pedal and a throttle position signal generated by a throttle position sensor (TPS) 42. A throttle actuator adjusts the throttle position based on the throttle control signal. The throttle actuator may include a motor or a stepper motor, which provides limited and/or coarse control of the throttle position.

The main control module 40 also regulates a fuel injection system 43 and the camshaft phasors 32, 34. The main control module 40 determines the positioning and timing (e.g. phase) between the intake or exhaust camshafts (intake or exhaust valves) 16, 18 and the crankshaft based on the output of the camshaft position sensors 36 and other sensors 47. For example, the positioning and timing may be adjusted based on a temperature signal from a hydraulic temperature sensor 45 and/or a voltage of an energy source 49. The temperature sensor 45 may provide temperature of oil within the engine 14 and/or in a camshaft phasor control circuit, such as that shown in FIG. 2. The other sensors may include the sensors mentioned below.

An intake air temperature (IAT) sensor 44 is responsive to a temperature of the intake air flow and generates an intake air temperature signal. A mass airflow (MAF) sensor 46 is responsive to the mass of the intake air flow and generates a MAF signal. A manifold absolute pressure (MAP) sensor 48 is responsive to the pressure within the intake manifold 20 and generates a MAP signal. An engine coolant temperature sensor 50 is responsive to a coolant temperature and generates an engine temperature signal. An engine speed sensor 52 is responsive to a rotational speed of the engine 14 and generates an engine speed signal. Each of the signals generated by the sensors is received by the main control module 40.

The camshaft phasor control system 12 further includes a park state detector. The park state detector 60 detects when the engine is in a park state. The park state refers to when the engine is initially started. The park state detector 60 indicates that the camshafts 16, 18 are at initial startup positions, which may be default positions when at rest. For example, upon shutdown of the engine 14 the intake and exhaust camshafts 16, 18 may be forced to known fixed predetermined positions. Also, upon startup of the engine, initial predetermined CHDC values may be used during camshaft phasor control. The predetermined CHDC values may be default values or values stored during a previous operating event. The park state detector 60 may include an engine sensor, a transmission sensor, an ignition sensor, etc. The park state detector 60 may be part of the control module 40.

Figure 2:
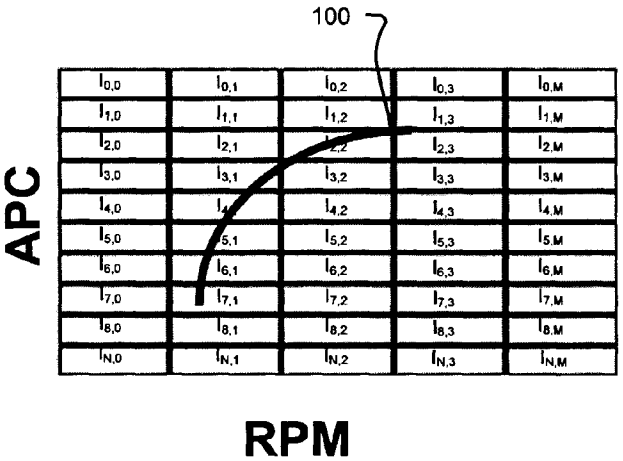
FIG. 2 is an exemplary table providing intake command phasor positions as a function of velocity and load in accordance with an embodiment of the present disclosure.

Referring now to FIG. 2, a first table providing intake command phasor positions $I_{0,0}$-$I_{N,M}$ as a function of velocity and load is shown. N and M are integer values. The first table may be used to generate desired or commanded intake phasor position signals. The first table is for example only; other tables and/or techniques may be used. A sample curve 100 is overlaid on the first table and indicates a change in an engine operating condition that would result in a change in the commanded intake phasor position. APC is an example measurement of load. Depending upon the APC and the velocity associated with the intake camshaft, a predetermined and/or stored commanded position value may be retrieved from the table to generate a commanded intake camshaft position signal. The APC values may provide the vertical coordinate in the first table and the velocity values may provide the horizontal coordinate in the first table.

Figure 3:
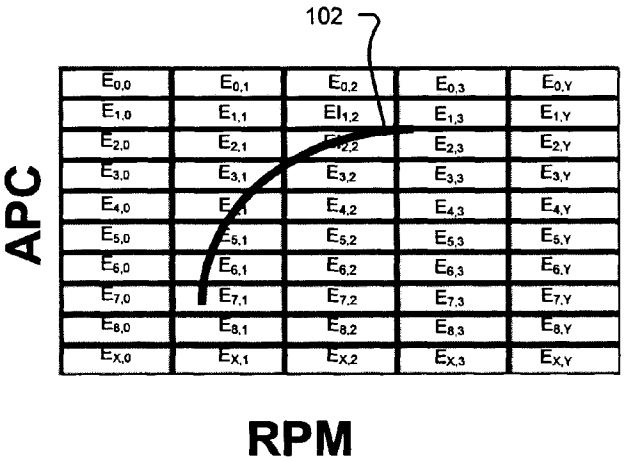
FIG. 3 is an exemplary table providing exhaust command phasor positions as a function of velocity and load in accordance with an embodiment of the present disclosure.

Referring now to FIG. 3, a second table providing exhaust command phasor positions $E_{0,0}$-$E_{X,Y}$ as a function of velocity and load is shown. X and Y are integer values. The second table may be used to generate desired or commanded exhaust phasor position signals. The second table is for example only; other tables and/or techniques may be used. A sample curve 102 is overlaid on the second table and indicates a change in an engine operating condition that would result in a change in the commanded exhaust phasor position. Depending upon the APC and the velocity associated with the crankshaft, a predetermined and/or stored commanded position value may be retrieved from the table to generate a commanded exhaust camshaft position signal. The APC values may provide the vertical coordinate in the second table and the velocity values may provide the horizontal coordinate in the second table.

Referring now to FIG. 4, an exemplary phase control diagram illustrating camshaft phasor variability is shown. The phase control diagram provides a plot of camshaft velocities (phi dot-timing angle of camshaft) relative to commanded duty cycle values. The timing angle of the camshaft may be relative to a crankshaft position. Variance between camshaft velocities is shown and increases with speed. A null duty cycle range which may be referred to as a control hold duty cycle (CHDC) and is shown to be about a 50% commanded duty cycle. The null duty cycle range may be approximately 50%±5%. The lower and upper boundaries of the null duty cycle range are identified as B and C. A minimum duty cycle for a change in camshaft velocity A and a maximum duty cycle for a change in camshaft velocity D are identified. Variability between phasors is shown by arrows 120, 122.

The phase control diagram may be divided along the 50% commanded duty cycle to generate two tables, one for retarding and one for advancing camshaft positioning. Two tables may be associated with each camshaft. Each table may be used to compensate for forces exerted on or restricting movement of the camshafts, such as the forces of an engine that aid (support) or abet (oppose) direction of motion of the camshafts. The direction of motion refers to the angular motion of the camshafts relative to each other and/or the position adjustment of the corresponding phasors.

Figure 5:
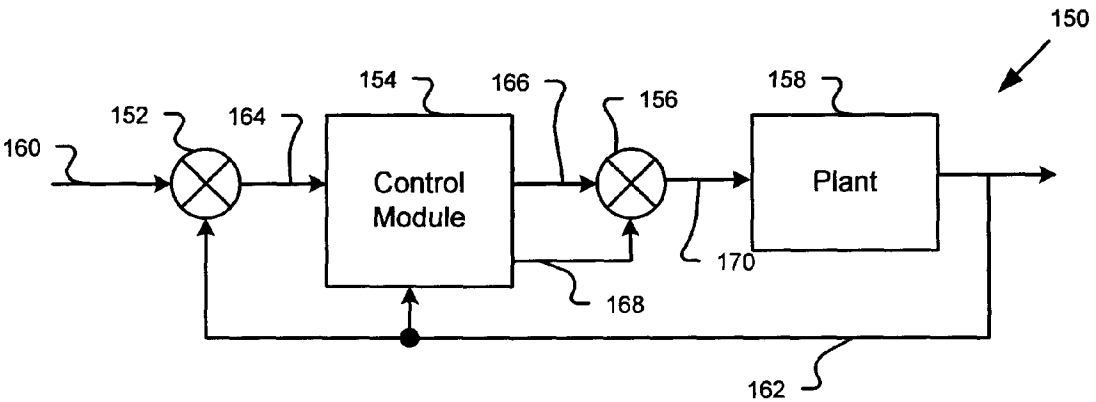
FIG. 5 is a functional block diagram of a camshaft phasor control system in accordance with an embodiment of the present disclosure.

Referring now to FIG. 5, a functional block diagram of a camshaft phasor control system 150 is shown. The camshaft phasor control system 150 includes a first summer 152, a control module 154, a second summer 156, and a plant 158. The camshaft phasor control system 150 is shown as a closed loop system. The first summer 152 receives and compares commanded camshaft position signals to actual camshaft position signals. For example a commanded camshaft position signal 160 is compared with an actual camshaft position signal 162 to generate an error signal 164.

The generated error signals are provided to the control module 154. The control module 154 may be part of or replace the main control module 40 of FIG. 1. An example intake position error signal $e_I$ is provided by equation 1 and an example exhaust position error signal $e_E$ is provided by equation 2, where $\phi_{IC}$ is a commanded intake phasor position, $\phi_{IA}$ is an actual intake phasor position, $\phi_{EC}$ is a commanded exhaust phasor position, and $\phi_{EA}$ is an actual exhaust phasor position.

$$e_I = \phi_{IC} - \phi_{IA} \tag{1}$$

$$e_E = \phi_{EC} - \phi_{EA} \tag{2}$$

The control module 154 generates a raw duty cycle signal 166 based on the error signals. The control module 154 may be a proportional, integral derivative (PID) controller and have stored tables relating the error signals to duty cycles.

The control module 154 also generates a modifier signal 168 based on a calculated camshaft ratio R. To calculate the camshaft ratio R, the control module 154 determines the velocities of the intake camshaft $$\frac{d\phi_I}{dt}$$

and the exhaust camshaft $$\frac{d\phi_E}{dt}.$$

The intake and exhaust camshaft velocities $$\frac{d\phi_I}{dt}, \frac{d\phi_E}{dt}$$

may be determined using equations 3 and 4. The camshaft velocities $$\frac{d\phi_I}{dt}, \frac{d\phi_E}{dt}$$

may refer to the relative speed of camshafts, as well as relative speeds of phasors, as they are directly related. A camshaft position is directly related to the position of a phasor or the position of a vane of a phasor. As the position of a vane of a phasor moves, the position of the camshaft moves.

$$\frac{d\phi_I}{dt} = \frac{\phi_{IC} - \phi_{IA}}{\Delta t} \tag{3}$$

$$\frac{d\phi_E}{dt} = \frac{\phi_{EC} - \phi_{EA}}{\Delta t} \tag{4}$$

The control module 154 also determines an intake target time $t_I$ and an exhaust target time $t_E$ based on the camshaft velocities $$\frac{d\phi_I}{dt}, \frac{d\phi_E}{dt},$$

as provided by equations 5 and 6.

$$t_I = \frac{e_I}{\frac{d\phi_I}{dt}} \tag{5}$$

$$t_E = \frac{e_E}{\frac{d\phi_E}{dt}} \tag{6}$$

The intake target time $t_I$ and the exhaust target time $t_E$ represent the amount of time for the intake and exhaust camshafts to reach target positions.

The camshaft ratio R is then calculated. The camshaft ratio R may be calculated using equation 7.

$$R = \frac{t_I}{t_E} = \frac{e_I d\phi_E}{e_E d\phi_I} \tag{7}$$

The control module 154 generates the modifier signal 168 based on the camshaft ratio R and based on whether the current position of a camshaft is above or below the null duty cycle range for that camshaft. The control module 154 may determine the modifier signal 168 based on predetermined values stored in a tabular form. Table 3 is provided as an example for the determination of a modifier, which is used to generate the modifier signal 168.

TABLE 3

Camshaft Ratio to Duty Cycle Modifier Conversion

| Camshaft Ratio (R) | Commanded Duty Cycle | Modifier |
|---|---|---|
| R > 1 Adjust Exhaust | $DC_{ex}$ > Null $DC_{ex}$ Range | −((1-(1/R))(D-C) |
| Camshaft Position | $DC_{ex}$ < Null $DC_{ex}$ Range | ((1-(1/R))(B-A) |
| R < 1 Adjust Intake | $DC_{in}$ > Null $DC_{in}$ Range | −(1-R)(D-C) |
| Camshaft Position | $DC_{in}$ > Null $DC_{in}$ Range | (1-R)(B-A) |

A-D identify the lower and upper boundaries of the null commanded duty cycle range, the minimum duty cycle for a change in camshaft velocity, and the maximum duty cycle for a change in camshaft velocity as shown in FIG. 4. As shown in table 3, the modifier may be different depending upon the camshaft ratio R and the commanded duty cycle. In one embodiment, when the camshaft ratio R>1, the intake camshaft is moving slower than the exhaust camshaft. The exhaust camshaft speed is adjusted via the modifier. When the camshaft ratio R<1, the exhaust camshaft is moving slower than the intake camshaft. The intake camshaft speed is adjusted via the modifier. When the camshaft ratio R=1, the intake and exhaust camshafts are moving at speeds, which make the intake target time and the exhaust target time equal and no adjustment is needed. The modifier may be set equal to 0.

The modifier signal 168 is summed with the duty cycle signal 166 by the second summer 156 to generate a modified duty cycle signal 170. The modified duty cycle signal 170 is provided to the plant 158. The plant 158 may refer to and/or include control valves, phasors, camshafts, etc. The modified duty cycle signal 170 may be provided to a control valve or a phasor to adjust position of one of the camshafts. In one embodiment, control reduces the speed of the faster moving camshaft, as shown by table 1.

Figure 6:
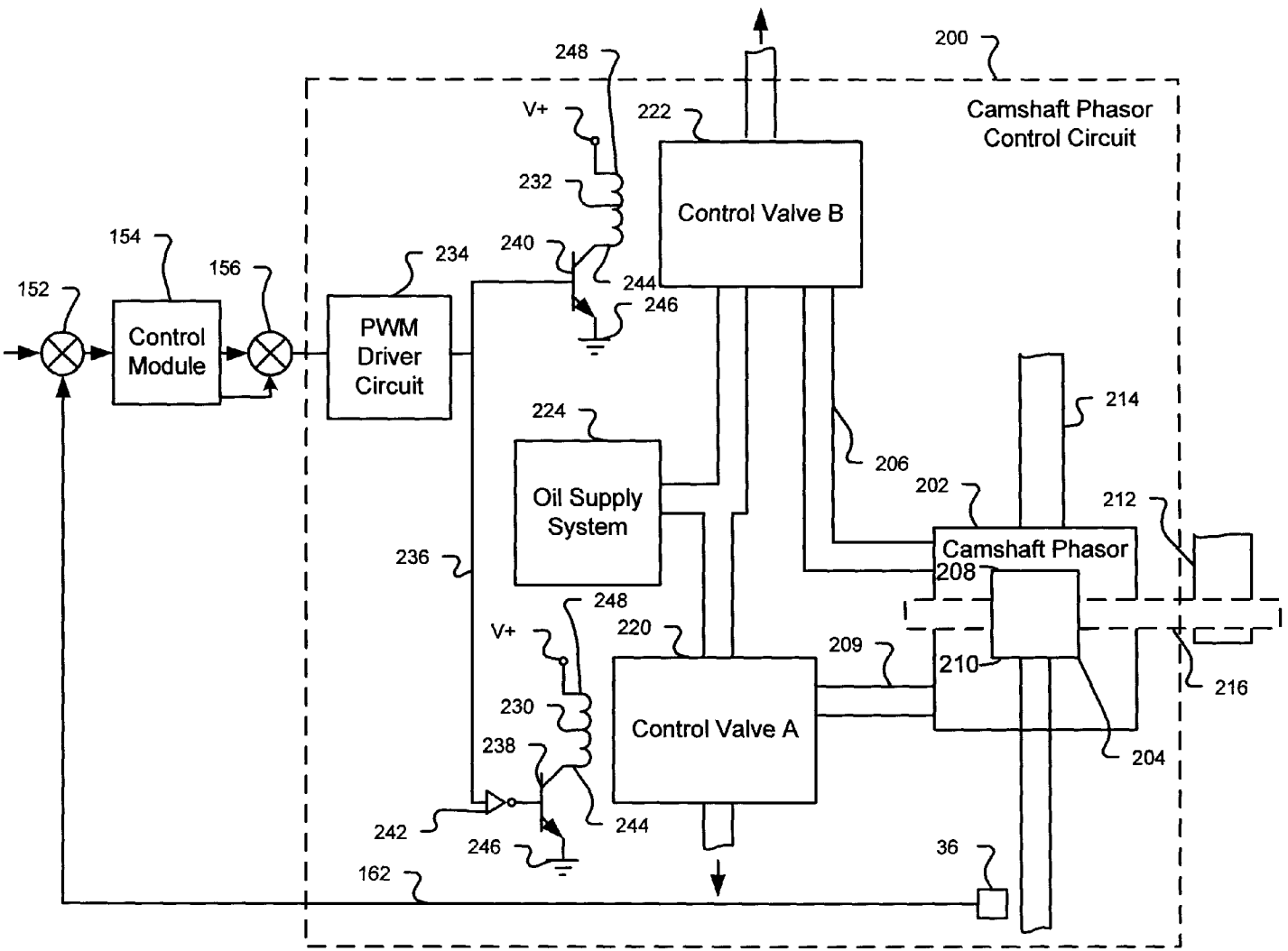
FIG. 6 is a functional block diagram illustrating an exemplary camshaft phasor actuation system in accordance with an embodiment of the present disclosure.

Referring now to FIG. 6, a functional block diagram illustrating an exemplary camshaft phasor actuation system 200 is shown. A single actuation system is shown for simplicity. An actuation system may be included for each camshaft phasor. The actuation system 200 controls position of a phasor (hydraulic actuator) 202, which may include a piston (valve shuttle) 204, to provide for linear positioning thereof along a range of motion. The piston 204 may move bi-directionally. The piston 204 may move in a first direction when hydraulic fluid pressure from passage 206 is applied to a first side 208 of the piston 204. The piston 204 may move in a reverse direction of motion when fluid pressure from second passage 209 is applied to a second side 210 of the piston 204. The piston 204 moves, as influenced by hydraulic pressure applied thereto, along a sleeve attached to the phasor 202. The phasor 202 varies angular relationship between an engine crankshaft 212 and camshaft 214. For example, the piston 204 may be attached, via a paired block configuration or a helical spline configuration, to a toothed wheel. A chain 216 may be disposed on the toothed wheel and linked to the crankshaft 212. The phasor 202 is mechanically linked to the camshaft 214.

A control valve A 220 and a control valve B 222 are positioned to admit a varying quantity of hydraulic fluid through respective first and second passages 206, 209. The relative pressure applied to the sides determines the steady state position of the piston 204. Precise piston positioning along a continuum of positions within the sleeve of phasor 202 is provided through precise control of the relative position of control valves 220 and 222. The control valves 220, 222 receive hydraulic fluid, such as conventional engine oil, from an oil supply system 224. The oil supply system 224 may include an oil pump, which draws hydraulic fluid from a reservoir and passes the fluid to an inlet side of each of the control valves 220, 222 at a regulated pressure. The control valves 220, 222 may be three-way valves that have linear and magnetic field-driven solenoids.

The control valves 220, 222 are positioned based on current provided to coils 230, 232 of solenoids. In a rest position, the control valves 220, 222 are positioned to vent out fluid away from the piston 204, such that position of the piston 204 is not influenced by fluid pressure. As the control valves 220, 222 are actuated away from their rest positions, a portion of the vented fluid is directed to the corresponding sides and displacement of the piston 204.

Pulse width modulation (PWM) control is provided by current control of the coils 230, 232 via a PWM driver circuit 234. The PWM driver circuit 234 converts the modified duty cycle 170 into a PWM signal 236. The coils 230, 232 are activated via transistors 238, 240. The PWM signal 236 is passed to the first transistor 238 in uninverted form, and is passed in inverted form, via an inverter 242, to the second transistor 240. The PWM signal 236 may be a variable duty cycle signal and be similar to a limited and converted version of the modified duty cycle signal 170. The PWM signal 236 is applied to the bases of the transistors 238, 240. The inverting of the PWM signal 236 via inverter 242 provides activation of one transistor and deactivation of the transistor.

The transistors 238, 240 are connected between a low side 244 of the respective coils 230, 232 and a ground reference 246. A high side 248 of the coils 230, 232 is electrically connected to a supply voltage V+. The control valves 220, 222 are held, for a given duty cycle, in a fixed position corresponding to the average current in the coils 230, 232.

The position of the piston 204 is detected by the camshaft position sensor 36, and may be positioned in proximity to piston 204 to sense piston displacement. The position sensor 36 may generate the camshaft position signal 162, which is fed back to the main control module 154. The control module 154, through execution of periodic control operations, may generate the command duty cycle 166.

Figure 7:
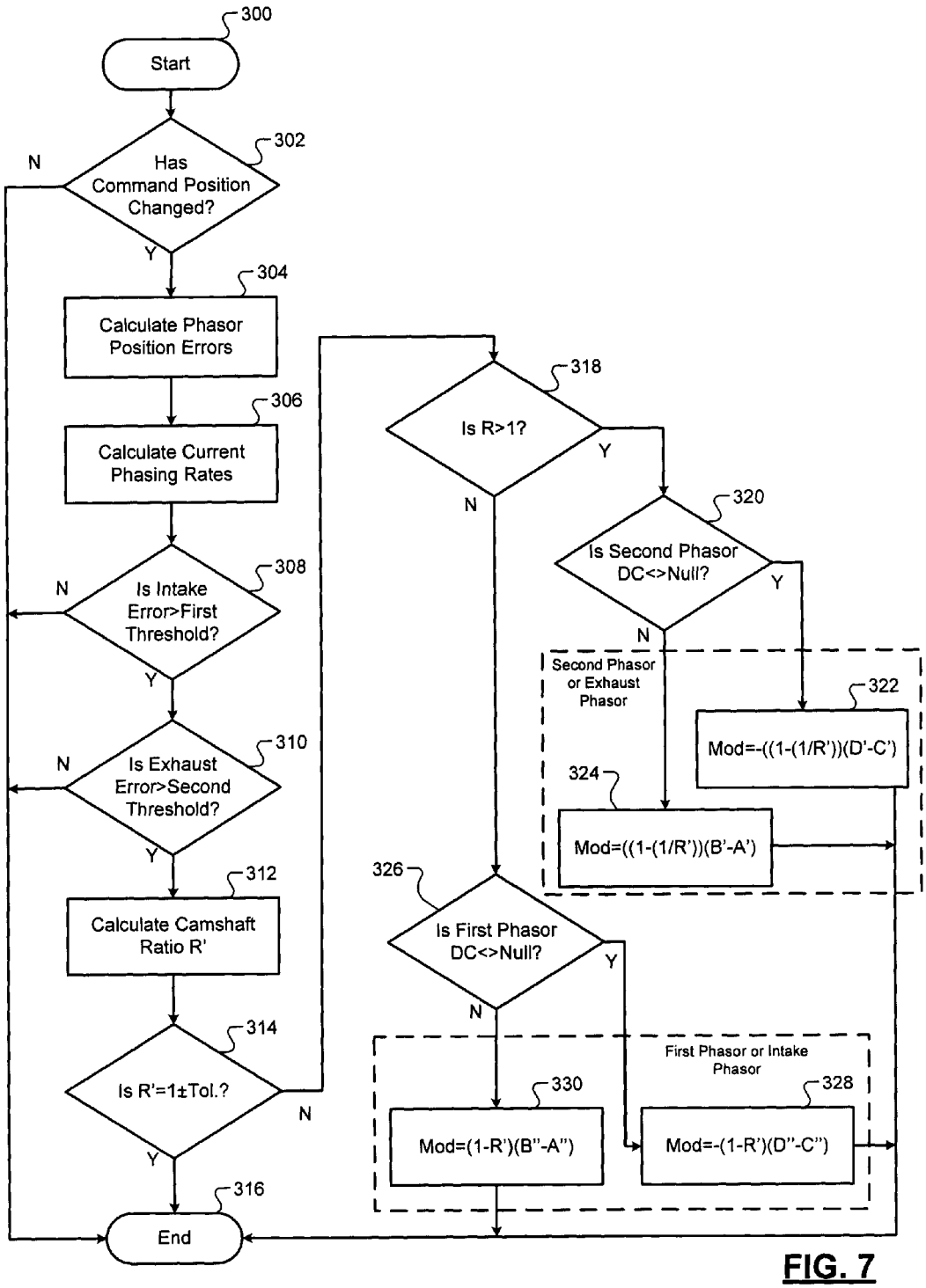
FIG. 7 is a logic flow diagram illustrating a method of operating a camshaft phasor control system in accordance with an embodiment of the present disclosure.

Referring now to FIG. 7, a logic flow diagram illustrating a method of operating a camshaft phasor control system is shown. Although the following steps are primarily described with respect to the embodiments of FIGS. 3, 5 and 7, they may be easily modified to apply to other embodiments of the present invention. Also, the below steps are described with respect to two camshafts and control thereof, the steps may be applied to any number of camshafts. The steps may be applied to intake camshafts, exhaust camshafts, or a combination thereof. Also, the control described below may be performed by a control module, such as by one of the control modules 40 and 154, of a camshaft phasor control system. The method may begin at 300.

In step 302, when a commanded camshaft position (phasor position) has changed, the control proceeds to step 304, otherwise control proceeds to step 316 and ends. In step 304, control calculates phasor position errors, such as the intake and exhaust position errors $e_I$, $e_E$. In step 306, control calculates current phasing rates, such as intake camshaft velocity $$\frac{d\phi_I}{dt}$$

and the exhaust camshaft velocity $$\frac{d\phi_E}{dt}.$$

In step 308, when the intake position error $e_I$ is greater than a first threshold, control proceeds to step 310, otherwise control proceeds to step 316. In step 310, when the exhaust position error $e_E$ is greater than a second threshold, control proceeds to step 312, otherwise control proceeds to step 316.

In step 312, control calculates a camshaft ratio R'. Control may determine an intake target time and an exhaust target time, such as the target times $t_I$, $t_E$, as provided in equations 5 and 6. Control may determine the camshaft ratio R' based on the target times $t_I$, $t_E$ and the phasing rates. An example is provided by equation 7.

In step 314, when the camshaft ratio R' is approximately equal to 1± a tolerance factor, control proceeds to step 316, otherwise control proceeds to step 318. In step 318, when the camshaft ratio R' is greater than one (1) control proceeds to step 320, otherwise control proceeds to step 326.

In step 320, when the commanded duty cycle is greater than the second control hold duty cycle range for a second camshaft, control proceeds to step 322, otherwise control proceeds to step 324. In step 322, a modifier is generated based on the camshaft ratio R', an upper boundary of the second null duty cycle range C', and a maximum duty cycle for a change in camshaft velocity of the second camshaft D'. The modifier may be set equal to −((1−(1/R'))(D'−C').

In step 324, a modifier is generated based on the camshaft ratio R', a lower boundary of the second null duty cycle range A', and a minimum duty cycle for a change in camshaft velocity of the second camshaft C'. The modifier may be set equal to ((1−(1/R'))(B'−A').

In step 326, when the commanded duty cycle DC is greater than the first control hold duty cycle range for a first camshaft, control proceeds to step 328, otherwise control proceeds to step 30. In step 328, a modifier is generated based on the camshaft ratio R', an upper boundary of a first null duty cycle range C", and a maximum duty cycle for a change in camshaft velocity of the first camshaft D". The modifier may be set equal to −(1−R')(D"−C"). The values D' and C' may be equal to the values D" and C", respectively.

In step 330, a modifier is generated based on the camshaft ratio R', a lower boundary of the first null duty cycle range B", and a minimum duty cycle for a change in camshaft velocity of the first camshaft A". The modifier may be set equal to (1−R')(B"−A"). The values B' and A' may be equal to the values B" and A", respectively.

The above-described steps may include additional enablement conditions for enabling the operation of steps 300-330. The above-described steps may be continuously repeated. The above-described steps are meant to be illustrative examples; the steps may be performed sequentially, synchronously, simultaneously, during overlapping time periods or in a different order depending upon the application.

The embodiments allow a system to more quickly arrive at a desired operating condition. Put another way, a system may obtain desired camshaft positions quicker. This allows for fuel savings. For example, a certain amount of diluent may be trapped in the cylinders of an engine to provide a particular level of emissions and fuel economy. When too much diluent is trapped, performance may be degraded, whereas when not enough diluent is trapped, emissions and fuel economy may be degraded. When camshafts are moving at different velocities it is difficult for a system to predict camshaft positioning. The present invention allows for quick synchronization of camshafts to allow for accurate camshaft positioning prediction. This allows a system to quickly reach a dilution limit, which refers to when a peak amount of diluent is captured in a cylinder without preventing combustion. The embodiments thus provide an appropriate amount of overlap.

In the embodiment of the present application, as the operating conditions change, the tables provide different upper and lower boundaries, limits, thresholds and modifiers to adjust phasor positioning. This provides predictable camshaft performance and combustion stability. Predictable camshaft phasor positioning allows for proper spark timing, fuel injection timing, etc.

The embodiments disclosed herein provide adaptive camshaft phasor control systems that account for changes in engine state parameters and adjust for changes in engine components, such as due to wear over time. The embodiments are also insensitive to build variations.

The systems and circuits have reduced sensitivity to voltage, temperature and component build variations. In addition, the systems and methods enable less stringent design requirements on phasors.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A camshaft phasor control system for an engine comprising:

a first camshaft position sensor generating a first camshaft position signal based on a position of a first camshaft;

a first summer that generates a first error signal based on said first camshaft position signal and a first commanded position signal;

a control module that generates a raw duty cycle based on said first error signal; and a second summer that generates a modified duty cycle based on said raw duty cycle and a modifier, wherein said control module generates said modifier based on said first error signal and speed of said first camshaft relative to a second camshaft.

2. The camshaft phasor control system of claim 1 further comprising:

a second camshaft position sensor generating a second camshaft position signal based on a position of a second camshaft; and a third summer that generates a second error signal based on said second camshaft position signal and a second commanded position signal, wherein said control module determines speed of said second camshaft based on said second error signal.

3. The camshaft phasor control system of claim 2 wherein said control module generates said modifier based on said first error signal, said second error signal, speeds of said first camshaft and said second camshaft, and a duty cycle threshold.

4. The camshaft phasor control system of claim 2 wherein said control module determines a camshaft ratio based on said first error signal, said second error signal and speeds of said first camshaft and said second camshaft, and wherein said control module generates said modifier based on said camshaft ratio.

5. The camshaft phasor control system of claim 4 wherein said control module determines said camshaft ratio by multiplying said first error signal by speed of said second camshaft to generate a first time, by multiplying said second error signal by speed of said first camshaft to generate a second time, and by dividing said first time by said second time.

6. The camshaft phasor control system of claim 4 wherein said control module reduces speed of said second camshaft when said camshaft ratio is greater than 1.

7. The camshaft phasor control system of claim 4 wherein said control module reduces speed of said first camshaft when said camshaft ratio is less than 1.

8. The camshaft phasor control system of claim 4 wherein said control module maintains speed of said first camshaft and speed of said second camshaft when said camshaft ratio is equal to 1.

9. The camshaft phasor control system of claim 1 wherein said control module determines that the speed of said first camshaft is greater than the speed of said second camshaft, and wherein said control module reduces speed of said first camshaft.

10. The camshaft phasor control system of claim 1 wherein said control module generates said modifier based on a null duty cycle range.

11. The camshaft phasor control system of claim 1 wherein said control module generates said modifier based on at least one of a minimum duty cycle for a change in camshaft speed and a maximum duty cycle for a change in camshaft speed.

12. A camshaft phasor control system for an engine comprising:

a first camshaft phasor position sensor generating a first phasor position signal based on a position of a first phasor;

a first summer that generates a first error signal based on said first phasor position signal and a first commanded position signal;

a control module that generates a raw duty cycle based on said first error signal; and a second summer that generates a modified duty cycle based on said raw duty cycle and a modifier, wherein said control module generates said modifier based on said first error signal and speed of said first phasor relative to a second phasor.

13. The camshaft phasor control system of claim 12 further comprising:

a second camshaft phasor position sensor generating a second phasor position signal based on a position of a second phasor; and a third summer that generates a second error signal based on said second phasor position signal and a second commanded position signal, wherein said control module determines speed of said second phasor based on said second error signal, and wherein said control module adjusts speed of said first phasor based on said speed of said second phasor.

14. The camshaft phasor control system of claim 13 wherein said control module determines a camshaft ratio based on said first error signal, said second error signal and speeds of said first phasor and said second phasor, and wherein said control module generates said modifier based on said camshaft ratio.

15. The camshaft phasor control system of claim 12 wherein said control module determines that the speed of said first phasor is greater than the speed of said second phasor, and wherein said control module reduces speed of said first phasor.

16. The camshaft phasor control system of claim 12 wherein said control module generates said modifier based on a null duty cycle range.

17. The camshaft phasor control system of claim 12 wherein said control module generates said modifier based on at least one of a minimum duty cycle for a change in camshaft speed and a maximum duty cycle for a change in camshaft speed.

18. A method of operating a camshaft phasor control system for an engine comprising:

generating a first camshaft position signal based on a position of a first camshaft;

generating a first error signal based on said first camshaft position signal and a first commanded position signal;

generating a second camshaft position signal based on a position of a second camshaft;

generating a second error signal based on said second camshaft position signal and a second commanded position signal; and generating a duty cycle for said first camshaft based on said first error signal, said second error signal, and speed of said first camshaft relative to said second camshaft.

19. The method of claim 18 further comprising:

generating a raw duty cycle based on said first error signal;

generating a modified duty cycle based on said raw duty cycle and a modifier; and generating said modifier based on said first error signal and speed of said first camshaft relative to said second camshaft.

20. The method of claim 18 further comprising:

determining a camshaft ratio based on said first error signal, said second error signal and speeds of said first camshaft and said second camshaft;

generating a modifier based on said camshaft ratio; and adjusting speed of said first camshaft based on said camshaft ratio.

* * * * *